United States Patent [19]

Li

[11] 4,082,650

[45] Apr. 4, 1978

[54] MANUFACTURE OF PETROLEUM COKE WITH FINES RECYCLING

[75] Inventor: Ke Wen Li, Ponca City, Okla.

[73] Assignee: Continental Oil Company, Ponca City, Okla.

[21] Appl. No.: 757,426

[22] Filed: Jan. 7, 1977

Related U.S. Application Data

[63] Continuation of Ser. No. 640,827, Nov. 28, 1975, abandoned, which is a continuation of Ser. No. 485,174, Jul. 2, 1974, abandoned.

[51] Int. Cl.[2] ..... C10G 9/14

[52] U.S. Cl. ..... 208/131; 208/106

[58] Field of Search ..... 208/46, 106, 131

[56] References Cited

U.S. PATENT DOCUMENTS 3,116,231 12/1963 Adee ..... 208/131

*Primary Examiner*—Herbert Levine

*Attorney, Agent, or Firm*—Richard W. Collins

[57] ABSTRACT

Yield and coke quality of a delayed coking and coke calcining process is improved by addition of coke fines to a coke drum at a temperature approximately equal to or higher than that of the incoming liquid hydrocarbon residuum feedstock during the coking operation.

4 Claims, No Drawings

MANUFACTURE OF PETROLEUM COKE WITH FINES RECYCLING

This is a continuation of application Ser. No. 640,827 filed Nov. 28, 1975, which in turn is a continuation of Application Ser. No. 485,174, filed July 2, 1974 both now abandoned.

This invention relates to the manufacture of delayed petroleum coke and more particularly to improvement of yield and coke quality by addition of coke fines to the coke drum at a temperature approximately equal to the temperature of the liquid feedstock.

Delayed coking processes, recovery of fines, and utilization of such fines are described in U.S. Patents such as Nos. 3,116,231 to Adee and 3,173,852 to Smith. The Adee patent describes a delayed coking process using liquid hydrocarbon residuum feedstock with a commercial delayed coking unit. Coke fines are recovered, slurried with a gas oil sidestream, and added to the heated feedstock stream as it enters the delayed coke drums. The patent to Smith describes a similar delayed coking process in which coke fines are recovered from the gas stream of the inclined rotary calcining kiln. These fines are subsequently fluidized with air and burned within the kiln to supply a portion of the fuel requirements. Use of coke fines as a fuel decreases yield of coke from the delayed coking process and results in loss of high quality coke. Addition of such coke fines to the delayed coking process by previously known methods has been detrimental to the coke quality.

It has now been discovered that by adding coke fines to the delayed coke manufacturing process at a temperature approximately equal to or higher than the liquid hydrocarbon feedstock being used to produce the coke results in both increase in the overall coke yield and excellent quality coke. Coke manufacturing as used herein refers to the formation of coke in the coke drum and calcining of the coke. Recycling of coke fines as described herein also reduces pollution problems due to coke particles entrained in flue gases. Coke fines can be added to the delayed coking drums for this process either prior to the addition of liquid feedstock or continuously during the coking operation. The coke fines should be heated or preheated to a temperature approximately equal to the temperature of the liquid feedstock prior to contact of the coke fines and liquid feedstock. This can be done by charging coke fines to delayed coking drum, preheating the coke fines, and then continuing with a standard coking operation by addition of heated liquid feedstock to the coke drum under delayed coking conditions. The fines can also be preheated and added to the delayed coking drum continuously while the heated hydrocarbon feedstock is being added to the coke drum and coked therein.

This invention provides a delayed coking process using normally liquid hydrocarbon feedstock which comprises adding coke fines to a delayed coking drum with the coke fines at a temperature approximately equal to or higher than the coking temperature of said liquid feedstock, heating said feedstock to its coking temperature, injecting or introducing said heated feedstock into the delayed coking drum, subjecting it to delayed coking conditions, forming delayed coke, recovering vaporous hydrocarbons overhead from said coking drum, and recovering said delayed coke from said delayed coking drum. This process is particularly advantageous for producing premium or needle delayed coke. The liquid hydrocarbon feedstock is heated to about 800°–1,200° F in a coker heater prior to introduction into the coke drum. The coke fines should be heated to a temperature in about the same range, or preferably a temperature above about 850° F.

Delayed coke is normally removed from delayed coke drums by mechanical and/or hydraulic means. It varies in size from large chunks of porous grayish-black material to fine dust. Coke fines as used herein refers to the smaller particles which are formed by attrition in the removal, grinding, handling, or transporting of this coke from the drum to subsequent processing steps. Coke fines are recognized in the arts as shown by patents cited above and other art. As used herein, coke fines refer to coke particles which normally cause difficulty in handling and would pass through a screen with about ⅛-inch openings. For addition to the delayed coking drums, coke fines can be any size. For maximum increase in overall yield, the recycled coke particles should be sized to pass through a 20 mesh U.S. standard sieve screen. Grinding or sizing of the coke fines prior to addition to the process can be used to obtain the desired coke particle size and particle size distribution. Preferred coke particle sizes are smaller than about 30 mesh size. Particle size or ranges refer to the sieve size through which the coke particles will pass and the screen size which will retain the particles.

Coke particles can be added to the process in the amounts desired. There is apparently no effect on coke quality by addition of coke fines to the process, especially on the CTE of the coke product. Addition of preheated coke fines does apparently improve other aspects of the coke quality, such as sulfur content as shown by the examples. Coke fines can be readily added to the delayed coking process up to about 15 percent based on the delayed coke produced. Preferred percentages of coke fines are up to about 10 percent and especially about 4–8 percent for ease of operation. Uncalcined or green petroleum coke fines are preferred for addition to the coking process but other petroleum coke fines can be used. As shown by the patent cited above, calcined coke fines are typically recovered in a cyclone from flue gases as they exit from the kiln. Fines can also be recovered from the processing coke stream at any stage using conventional separators such as screeners, pneumatic, or hydraulic classifiers, or any other classification means or method. Oversized particles or rejects from any processing step can be ground into fines and used for this process. For recovery of the preferred green or uncalcined fines, the coke stream should be screened or classified between the coke drum and the rotary kiln inlet. Since attrition during handling, transportation, and processing results in additional fines, separation of the fines may be desirable at several stages along the coke transporting and processing system.

In the delayed coking process, a petroleum fraction or normally liquid hydrocarbon is heated to a temperature at which it will thermally decompose into delayed coke and gaseous products. This liquid hydrocarbon fraction is fed into a delayed coking drum under conditions of time, temperature, and pressure which promote the formation of delayed coke and the desired gaseous products. This thermal decomposition produces a heavy tar and a porous coke mass in which the tar undergoes additional decomposition. The oil fraction is typically a residual oil or a blend of residual oil with other fractions. It is heated by any of several methods such as a heat exchanger, which recovers heat from the products, or a pipe still in which the fraction is heated directly to high temperatures. The oil fraction can be fed directly into the heating means or it can be fed into a fractionator. In a commercial unit, the feedstock is introduced into a fractionator. It blends with gaseous and liquid streams such as coker gas oil which are condensed gaseous products from the delayed coking drum. This coker gas oil is a recycle fraction. The feedstock for the coker heater is withdrawn as the bottoms fraction from the fractionator. It typically is considered to have about 1 volume of original feedstock blended in the fractionator with about 1 volume of recycle oil recovered from overhead products from the coking drum. Both of these streams pass through the fractionator and are subjected to fractionation therein. The recycle oil is considered to be a diluent fraction which does not substantially coke. This feedstock is heated to the desired coking temperature above about 900° F and introduced or injected into the delayed coking drum. The first stages of thermal decomposition produce the heavy tar or pitch and a mass of porous coke. Vapors from this decomposition flow through the mass of tar and porous coke and are removed overhead from the delayed coking drum. These vapors are condensed to form a recycle oil fraction which is typically returned to the coke drum.

Selection of a suitable charge stock or feedstock for the coking operation is well known in the art. Principle charge stocks are high boiling virgin or cracked petroleum residue such as virgin reduced crude, bottoms from vacuum distillation (referred to as vacuum reduced crude), Duo-Sol extract, thermal tar, other residue and blends thereof. In a preferred coking process, the feedstock is pumped through the coker heater at about 150–500 psi and heated to a temperature about 850°–950° F. It is then discharged or introduced into the delayed coking drum at a pressure of about 20–80 psi. The coke drum is typically of sufficient size, insulated or heated to maintain the temperature at about 830°–950° F. The feedstock introduced into the delayed coking drum and the tar mixed with any porous coke therein, decomposes over a period of time liberating the gaseous hydrocarbon products and producing delayed coke. Premium or needle delayed coke has a high degree of acicular crystalline structure or needlelike particles and a CTE of less than about 6 times $10^{-7}$/° C. The CTE is the coefficient of thermal expansion and is determined by a standard method. Low concentration of impurities such as sulfur are also required for premium coke.

EXAMPLE

A pilot plant delayed coker similar to the coking system shown in U.S. Pat. No. 3,116,231 to Adee is used to produce premium delayed coke. Four runs were made, two with the addition of coke fines according to this invention and two without coke fines for comparison. The results of these coker runs are shown in the table. The table shows the weight percent coke fines added based on the coke produced, the yields in weight percent of products from a fractionator, the coke yields based on a total feedstock and on the thermal tar feedstock for the coke fines deducted with 10 percent volatile matter and without volatile matter.

The pilot plant coker used for these runs is similar to the diagram shown in the patent to Adee with several exceptions. The pilot plant products are not recycled. Coker gas oil is blended with the pilot plant feedstock under controlled conditions. The feedstock is blended 50 volume percent thermal tar and 50 percent premium coker gas oil. This coker gas oil is equivalent to the recycle oil recovered from overhead gaseous products from the coke drums. This blended feedstock is fed directly to a heater where it is heated to about 850° F at about 100 psig from which it is introduced into a delayed coking drum at about 950° F and 25 psig. Overhead vapors are recovered by a condenser and a flash drum. These products are then fractionated in a vacuum tower at about 2 millimeters of pressure into the components shown in the table. Cycle oil is the bottoms fraction from the fractionator at about 700° F corrected to atmospheric pressure. This is the portion recycled in a commercial delayed coker. The premium coker gas oil initially blended with the thermal tar for feedstock corresponds to the bottoms from the fractionator.

The blended feedstock is fed directly through to heater at about 18 lb/hr and into the delayed coker for about 8 hours. After 8 hours, an additional portion of premium coker gas oil or recycle oil is fed through the unit without thermal tar. The feed is stopped and the delayed coking drum is heated at about 950° F for 2 hours. The drum is then steamed for 1 hour to remove volatile components remaining in the coke mass.

Coke fines are prepared for addition to the runs by grinding a premium coke having a CTE of $1.7 \times 10^{-7}$/° C, a sulfur content of 0.87 weight percent, and kerosene density of 2.14 grams per cubic centimeter. For Run No. 1, 453.6 grams (5.5 weight percent) of 30–50 mesh fines are added to the delayed coker drum at a temperature approximately equal to the feedstock. For Run No. 2, 400 grams of 30–50 mesh fines and 53.6 grams of 50–100 fines are added to the coke drum. Uncalcined premium coke is used in each case.

Data in the table show that the Runs 1 and 2 using 5.5 and 5.0 weight percent coke fines produced coke substantially equivalent to that produced in Runs 3 and 4 where no coke fines are added. The coke yield for Runs 1 and 2 have been adjusted by deducting the coke fines added to the delayed coking drum so that the yields are on the basis of total blended feedstock and thermal tar feedstock, respectively. CTE is the coefficient of thermal expansion according to a standard method. Sulfur content is determined by recovery of hydrogen sulfide from a pyrolysis of a coke sample. Volatile matter is determined by heating a coke sample at about a 950° C temperature to determine the weight loss by ASTM Method No. D-217. Kerosene density is determined by using a coke sample sized to pass through a U.S. No. 100 sieve. The coke sample is oven dried under vacuum at 100°–200° C. About 10 grams of coke are added to a 50 ml pycnometer containing standardized kerosene at 40° C. T,0090

I claim:

1. In a process for producing delayed petroleum coke comprising introducing a normally liquid hydrocarbon coker feedstock into a delayed coking drum under delayed coking conditions to produce delayed coke therein, the improvement wherein coke fines are added to said coking drum prior to introduction of said coker feedstock thereto, and said coke fines are preheated to approximately the temperature of said coker feedstock after being added to said coking drum but prior to introduction of said coker feedstock into said coking drum.

2. The process of claim 1 wherein said coke fines are uncalcined coke fines.

3. the process of claim 1 wherein said coker feedstock is a premium coke feedstock.

4. The process of claim 1 wherein said coke fines are preheated to a temperature of at least 850° F, have a particle size of less then 30 mesh, are uncalcined and are added in an amount of from 4 to 8 weight percent based on the coke produced.

* * * * *

UNITED STATES PATENT OFFICE

CERTIFICATE OF CORRECTION

PATENT NO. : 4,082,650

DATED : April 4, 1978

INVENTOR(S) : Ke Wen Li

It is certified that error appears in the above-identified patent and that said Letters Patent are hereby corrected as shown below:

Column 4, line 48, omit "T,0090" and insert following Table:

TABLE

| Run Conditions | With Fines Addition | | Without Fines Addition | |
|---|---|---|---|---|
| Pilot Coker Run Number | 1 | 2 | 3 | 4 |
| Coke fines added (wt% on coke produced) | 5.5 | 5.0 | 0 | 0 |
| Yields, wt% on furnace charge | | | | |
| $H_2$ | 0.04 | 0.05 | 0.05 | 0.07 |
| $C_1$-$C_4$ | 3.06 | 2.68 | 2.65 | 3.04 |
| Gas | 3.48 | 2.96 | 2.96 | 3.32 |
| Light Oil | 1.59 | 1.65 | 1.50 | 1.26 |
| Heavy Oil | 19.27 | 17.60 | 18.07 | |
| Cycle Oil | 62.74 | 64.33 | 64.49 | 81.96 |
| Coke yield | 12.92 | 13.46 | 12.98 | 13.46 |
| Coke yield (10% VM) | 13.17 | 13.56 | 13.05 | 13.49 |
| Coke yield (10% VM) (based on thermal tar feed) | 26.34 | 27.12 | 26.10 | 26.98 |
| Coke properties | | | | |
| Graphitized CTE $10^{-7}$/°C | 4.8 | 5.2 | 4.2 | 5.3 |
| Sulfur, wt% | 0.78 | 0.78 | 0.82 | 0.82 |
| Volatile Matter, wt% | 8.34 | 9.39 | 9.75 | 10.03 |
| Kerosene Density, g/cc | 2.12 | 2.12 | 2.12 | 2.12 |

Signed and Sealed this

Sixth Day of March 1979

[SEAL]

Attest:

RUTH C. MASON
*Attesting Officer*

DONALD W. BANNER
*Commissioner of Patents and Trademarks*